United States Patent [19]

Hirata

[11] Patent Number: 5,038,080

[45] Date of Patent: Aug. 6, 1991

[54] ELECTRIC FLASH APPARATUS

[75] Inventor: Shinji Hirata, Toyonaka, Japan

[73] Assignee: West Electric Co., Ltd., Osaka, Japan

[21] Appl. No.: 511,267

[22] Filed: Apr. 23, 1990

[30] Foreign Application Priority Data

Apr. 25, 1989 [JP] Japan ..... 1-104963
Apr. 28, 1989 [JP] Japan ..... 1-109442

[51] Int. Cl.[5] ..... H05B 41/14

[52] U.S. Cl. ..... 315/241 P; 315/340; 354/416

[58] Field of Search ..... 315/241 P, 241 S, 238, 315/340; 354/413, 416, 417

[56] References Cited

U.S. PATENT DOCUMENTS 4,697,906 10/1987 Kobayashi et al. .

4,839,686 6/1989 Hosomizu et al. .

*Primary Examiner*—Eugene R. LaRoche
*Assistant Examiner*—Amir Zarabian
*Attorney, Agent, or Firm*—Cushman, Darby & Cushman

[57] ABSTRACT

An electric flash apparatus of the present invention has an insulated Gate Bipolar Transistor (I.G.B.T.) for controlling the light emission actuation of the strobe tube (Xe), which is connected to the strobe tube in series, a switching element (11) for supplying a driving signal to the I.G.B.T. from a main capacitor ($C_M$), and a gate circuit (14) for controlling actuation of the switching element (11), which is connected across both ends of the strobe tube (Xe), and is actuated by a switch circuit (17) for actuating a trigger circuit (20). And the actuation of the switching element (11) is kept by turning on of the I.G.B.T.

7 Claims, 6 Drawing Sheets

ELECTRIC FLASH APPARATUS

FIELD OF THE INVENTION AND RELATED ART STATEMENT

1. Field of the Invention

The present invention relates to an electric flash apparatus having a power switching device, for instance, insulated gate bipolar transistor (hereinafter is referred to as I.G.B.T.) connected in series to a flash tube, i.e., a strobe tube, and more particularly to the electric flash apparatus wherein the power switching transistor is controlled by an output of a switch driving circuit.

2. Description of the Related Art

Hitherto, an electric flash apparatus having the power switching device connected in series to a strobe tube has been proposed, for instance in the U.S. Pat. No. 4,697,906, and apparatus using the I.G.B.T. is shown in the U.S. PAT. NO. 4,839,686.

The latter prior art apparatus has a circuit configuration as shown in FIG. 4. The prior art electric flash apparatus of FIG. 4 comprises a high voltage power source 1 consisting of a known DC-DC converter circuit, a constant voltage circuit 2 for supplying a constant voltage to the high voltage power source 1, a known trigger circuit 3 for making trigger operation of a strobe tube Xe, a control circuit 4 which is to be connected to a control circuit of a comera 7 and issues a trigger control signal and other related signals, a light control circuit 5 for controlling the ON-OFF state of the I.G.B.T., thereby to control total light amount (time-integration of flash light) of the strobe tube Xe and a double voltage circuit 6 for applying doubled voltage to the strobe tube Xe.

In the above-mentioned electric flash apparatus, when the power switch Sw in the high voltage power source 1 is closed, the power source circuit 1 starts operation and a main capacitor $C_M$ and a voltage doubling capacitor $C_2$ are charged by a high voltage generated by a secondary winding S of an oscillation transformer $T_1$. And further, by closing of the power switch Sw, a capacitor $C_1$ for supplying power to the control circuit 4 is charged by the low voltage of the battery E.

At the same time, the capacitor $C_3$ starts to be charged through a diode D and another transistor d. Thereby, the control circuit 4 starts operation, thereby to make a flash control circuit 5 a flashing standby state.

In the standby state where the above-mentioned capacitors $C_M$, $C_1$, $C_2$ and $C_3$ are charged up, the control circuit 4 receives a flash start signal from the control circuit of the camera 7. Then, the control circuit 4 outputs from its output terminal $O_1$ a trigger signal of H (high) level has a duty time to cover a longest light flashing time of the strobe tube Xe to the base of the transistor $Q_1$ in the flash control circuit 5. At this time, the output terminal $O_2$ of the control circuit 4 is in L (low) state, thereby keeping the transistor $Q_3$ OFF. Therefore, the transistor $Q_1$ becomes ON and hence the transistor $Q_2$ also ON and the charge of the capacitor $C_3$ is applied to the gate of the I.G.B.T.

Therefore, the I.G.B.T. is turned ON and the trigger capacitor $C_4$ is charged through the primary winding of the trigger transformer $T_2$. Accordingly, the secondary winding of the trigger transformer $T_2$ issues a trigger pulse. At the same time the plus side of the voltage doubling capacitor $C_2$ is grounded through a resistor $R_1$ and the collector-emitter circuit of the I.G.B.T. The charged voltage of the voltage doubling capacitor $C_2$ is superposed on the voltage of the main capacitor $C_M$, and the superposed sum voltage is applied to the strobe tube Xe.

As a result, the strobe tube Xe starts discharging by consuming electric charge mainly of the capacitor $C_M$ and emits light. During the light emission, when a light-stop pulse is sent from e.g. a light amount measuring circuit in the control circuit of the camera 7, the control circuit 4 issues from its output terminal $O_2$ an H level signal as light-stop signal to the bases of the transistors $Q_3$ and $Q_4$.

Therefore, the transistors $Q_3$ and $Q_4$ turns on, thereby short-circuiting the base-emitter circuit of the transistor $Q_1$ and gate-emitter circuit of the I.G.B.T., to turn off them. Hence, the transistor $Q_2$ also turns off, turning off the I.G.B.T.; and thereby the strobe tube Xe stops the light emission.

The above-mentioned prior art flash apparatus of FIG. 4 has the technical advantage that there is no excessive light emission due to the delay of the stop of discharge in the strobe tube and that it also can make high speed repeated flashing of light.

As a modified configuration of the prior art, FIG. 6(*a*) of the aforementioned U.S. Pat. No. 4,839,686 discloses another configuration shown in FIG. 5 attached here, wherein the driving signal for the I.G.B.T. is fed, not from the constant voltage circuit 2, but from the high voltage source point HV, that is from the main capacitor $C_M$. In this configuration, the collector-emitter circuit of a transistor $Q_1$ is connected across the base-collector circuit of a transistor $Q_5$. And the emitter of the transistor $Q_1$ is connected to the high voltage source point HV. And the base of the I.G.B.T. is connected to a voltage dividing point Vd; and further a Zener diode ZD is connected to the voltage dividing point Vd and the ground. Therefore, when a trigger signal is given and the transistor $Q_1$ is turned ON, the transistor $Q_5$ turns ON. And a constant voltage given from the dividing point Vd of the voltage divider and voltage-regulated by the Zener diode ZD is applied to the gate of the I.G.B.T. By this application of the regulated voltage, the I.G.B.T. turns ON, and makes the strobe tube Xe emit light.

By this configuration to receive the driving signal to the I.G.B.T. from the high voltage power source point HV, the constant voltage circuit 2 in the prior art circuit of FIG. 4 can be dispensed with. Therefore, this modified configuration of FIG. 5 has an advantage that the DC-DC converter of the DC high voltage power source 1 of FIG. 4 need not always be operated.

The above-mentioned prior art circuits of FIG. 4 amd FIG. 5 are configurated such that the driving signal for driving the I.G.B.T. is fed in ON state of the transistor $Q_1$, which is made ON responding to triggering signal given to its base. therefore, the triggering signal to make the I.G.B.T. ON must have a pulse width broader than the time period (which corresponds to light flashing time period) of discharging in the strobe tube Xe. This requires that the control circuit must have a special complicated circuit configuration so as to generate a triggering signal of the above-mentioned sufficient pulse width, hence requiring considerable power consumption therefore.

OBJECT AND SUMMARY OF THE INVENTION

The object of the present invention is to provide an electric flash apparatus having the I.G.B.T. which can start and keep the light emission of the strobe tube only by applying a trigger signal having very short duty time.

In order to achieve the above-mentioned object, the electric flash apparatus of the present invention comprises:

- a main capacitor which is connected across output terminals of a DC high voltage power source and is charged up by a DC high voltage current from the DC high voltage power source,
- a first series connection which comprises a strobe tube and an insulated gate bipolar transistor (I.G.B.T.) and is connected across both ends of the main capacitor,
- a second series connection which comprises a switching element and a constant voltage element and is connected across both ends of the main capacitor, a connecting point between the switching element and the constant voltage element being connected to the gate of the I.G.B.T.,
- gating means which is connected across both ends of the strobe tube and makes the switching element ON when electrified,
- trigger means for excitation of the strobe tube,
- switch means which is connected across both ends of the I.G.B.T. and actuates the gating means and the trigger means at reception of a signal for starting light emission, and
- control means which is connected across the gate and the emitter of the I.G.B.T., and when it becomes ON makes the I.G.B.T. OFF.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 3(*b*) is a partial circuit diagram of a fourth embodiment of the electric flash apparatus in accordance with the present invention.

DESCRIPTION OF THE PREFERRED EMBODIMENTS

Figure 1:
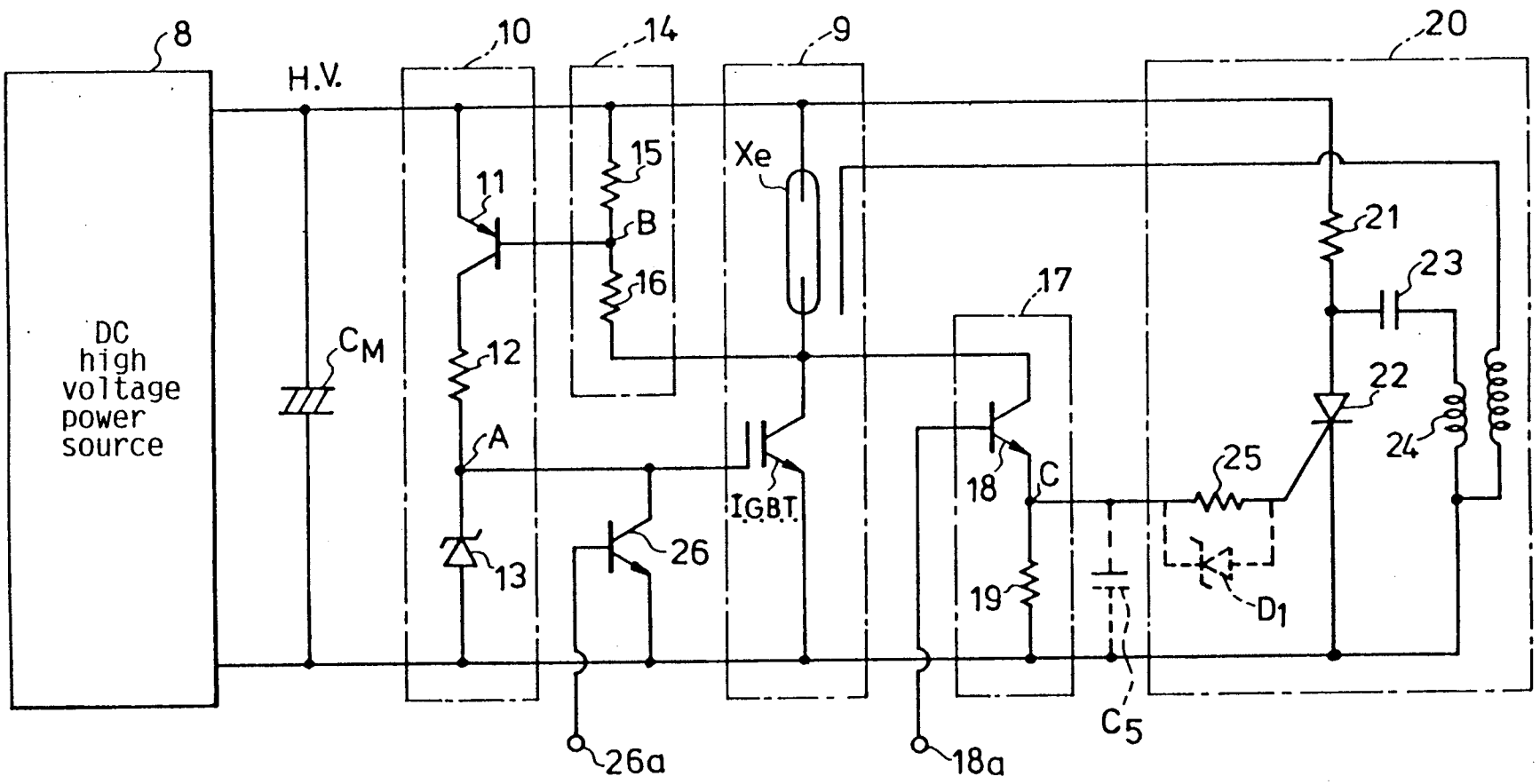
FIG. 1 is a circuit diagram of electric circuit of a first embodiment of an electric flash apparatus in accordance with the present invention.

Hereafter, a first embodiment in accordance with the present invention is described with reference to the accompanying drawing FIG. 1. FIG. 1. is a circuit diagram of electric circuit of the first embodiment of the electric flash apparatus.

Figure 4:
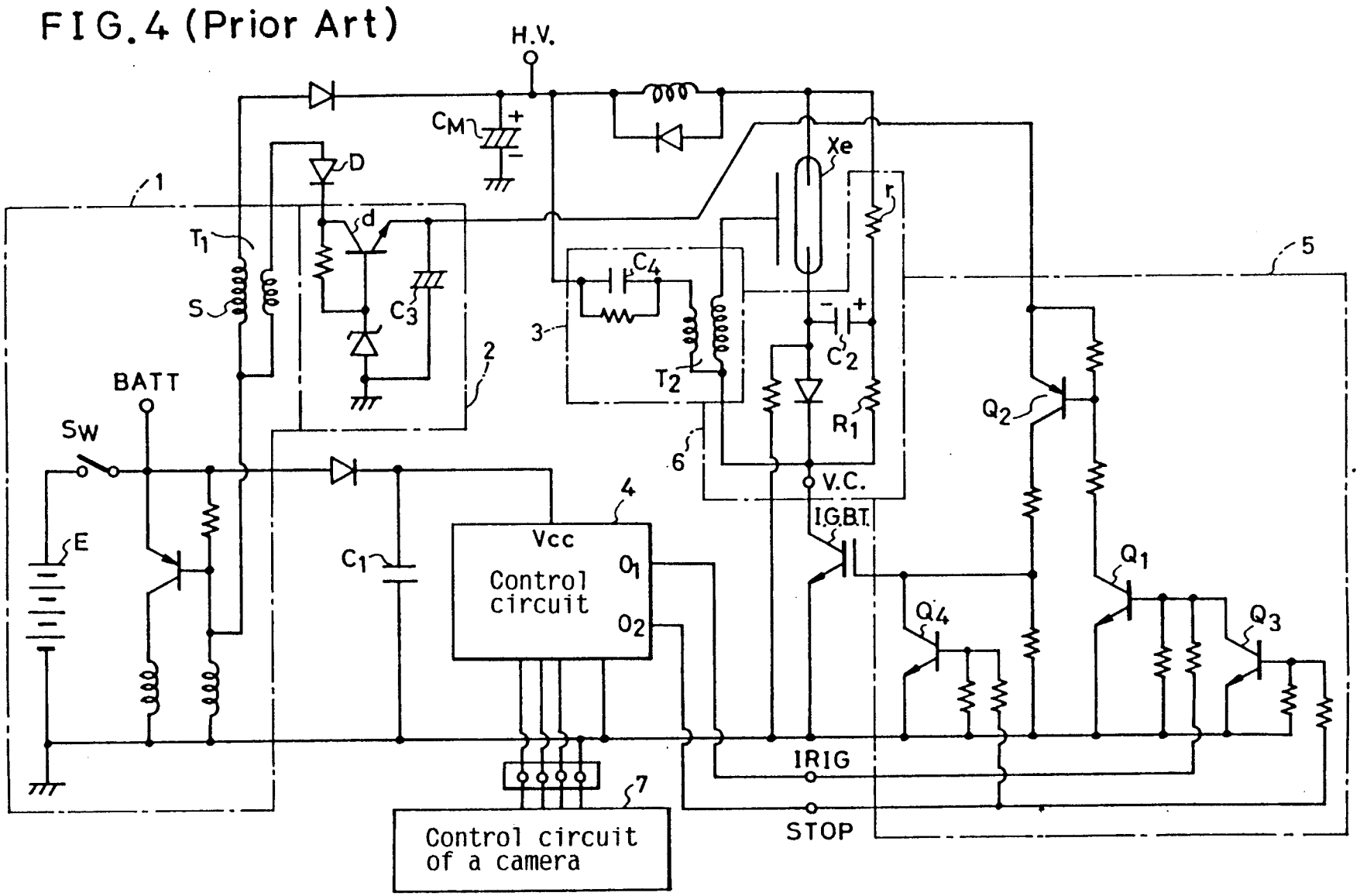
FIG. 4 (Prior Art)
FIGS. 4 and 5 are circuit diagrams of electric circuit in the prior art.
Figure 5:
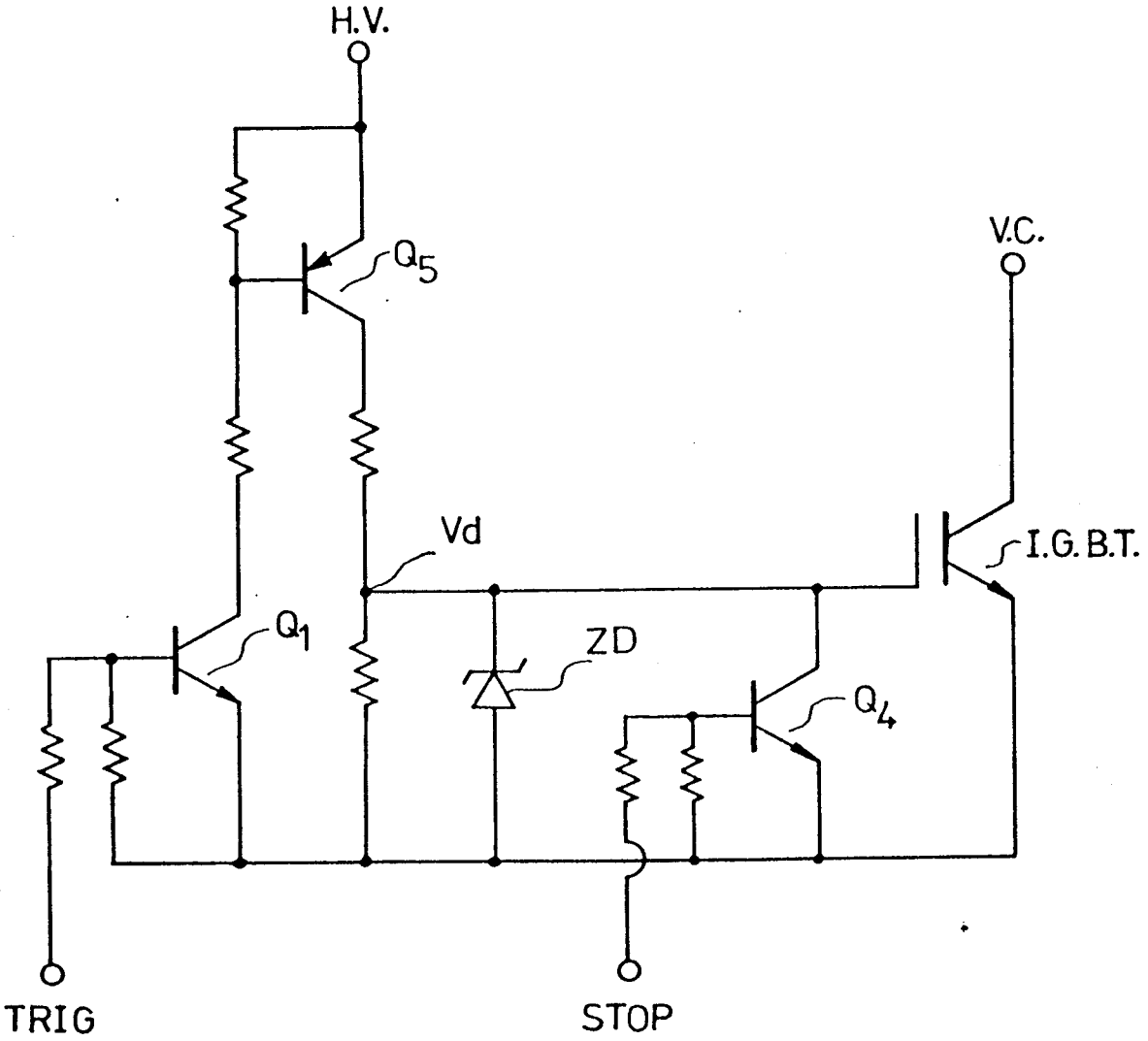
FIG. 5 (Prior Art)

In FIG. 1, corresponding parts and components to the afore-mentioned conventional electric flash apparatus shown in FIG. 4 are shown by the same numerals, and have same functions, respectively.

A main capacitor $C_M$ is connected across out put terminals of a DC high voltage power source 8 which comprises a known DC-DC converter circuit and a laminate battery etc. A first series connection 9, which comprises a strobe tube Xe and an I.G.B.T., and a second series connection 10, which comprises a transistor 11 as a switching element, a resistor 12 and a Zener diode 13 as a constant voltage element, are connected across both ends of the main capacitor $C_M$.

An anode of the Zener diode 13, namely a connecting point "A" between the resistor 12 and the Zener diode 13, is connected to the gate of the I.G.B.T..

A gate circuit (gating means) 14 is connected across both ends of the strobe tube Xe. The gate circuit 14 for gating the transistor 11 comprises a series connection of resistors 15 and 16, and a connecting point "B" therebetween is connected to the base of the transistor 11.

A switch circuit (switch means) 17 is connected across both ends of the I.G.B.T. And the switch circuit 17 comprises a transistor 18 as a switching element and a resistor 19. A connecting point "C" between the resistor 19 and the emitter is connected through a resistor 25 to a gate of a silicon controlled rectifier (hereinafter is referred to as SCR 22, which is a trigger switching element, of a trigger circuit 20.

The trigger circuit 20 comprises the SCR 22 and a resistor 25 for protection of the SCR 22. An electric charge charged in a trigger capactor 23 through a resistor 21. The charge is discharged by the SCR 22 through a trigger transformer 24 when the gate of the SCR 22 receives a trigger signal.

A transistor 26 as a control element is connected across the gate and the emitter of the I.G.B.T., and makes the I.G.B.T. OFF when it becomes ON.

A trigger signal for starting light emission is applied to the base 18*a*, which is the control gate of the transistor 18. And a stop signal for stopping light emission is applied to the base 26*a*, which is the control gate of the transistor 26.

Now, under the condition that the main capacitor $C_M$ and so on have completed their charging by the DC high voltage power source 8, when a high level pulse signal having very short duty time, which is the trigger signal, is applied to the base 18*a* of the transistor 18, the transistor 18 is turned ON and a current flows through the resistors 15, 16 and 19.

Owing to the voltage drop across the resistors 15, 16 and 19, the transistor 11 and the SCR 22 are turned ON, and the electric charge of the main capacitor $C_M$ is applied to the Zener diode 13. Simultaneously, the electric charge of the trigger capacitor 23 is discharged through the trigger transformer 24, and the strobe tube Xe is excited.

By the above-mentioned turning ON of the transistor 11, a predetermined voltage is outputted at the connecting point "A", and the voltage is applied to the gate of the I.G.B.T. Consequently, the I.G.B.T. is turned ON to allow a large current flow through the strobe tube Xe and the I.G.B.T., and therefore, the strobe tube Xe emits light by consuming the electric charge of the main capacitor $C_M$.

Once the I.G.B.T. is turned ON, a current which hitherto has flown through the gate circuit 14 and the switch circuit 17 is shifted to another flow, which is through the gate circuit 14 and the I.G.B.T. Thus, ON state of the transistor 11 is kept independently of the afore-mentioned ON-OFF state of the transistor 18 in the switch circuit 17, and as a matter of course, feed of driving signal for the I.G.B.T. from the main capacitor $C_M$ is kept.

It is enough that the transistor 18 in the switch circuit 17 is kept ON at least during the period from the application of the trigger signal, through the excitation (trigger operation) of the strobe tube Xe, till turning ON of the I.G.B.T. As a matter of course, the duty period of the trigger signal necessary for the above-mentioned triggering action is very short, and so the trigger signal may be a pulse signal of very short duty time.

At any point of time during the light emission of the strobe tube Xe, for example when the total (integrated) amount of light emission reaches a desired amount, a high level pulse signal having a predetermined duty time is applied as the stop signal to the base 26*a* of the transistor 26, from e.g. a known light amount measuring circuit (not shown in FIGS.), and the transistor 26 is turned ON. Thereby the gate and the emitter of the I.G.B.T. are shortcircuited, and the I.G.B.T. is turned OFF.

The discharge current flowing in the strobe tube Xe is interrupted by the turning OFF of the I.G.B.T., and at the same time the base current of the transistor 11, which flows through the gate circuit 14, is interrupted. By the turning OFF of the I.G.B.T., the light emission of the strobe tube Xe is stopped, the transistor 11 is turned OFF, and as a result the feed of the driving signal for the I.G.B.T. from the main capacitor $C_M$ is stopped. That is, the state of the apparatus restores to the initial state before the light emission. The light emission ends then.

When it happens rarely that after turning OFF of the I.G.B.T. the transistor 18 is still turned ON, a current undesirably flows through the gate circuit 14 and the switch circuit 17. But, such undesirable excess-period current can be omitted by setting the ON period of the transistor 26 be longer than that of the transistor 18 (which is determined by the very short duty time of the trigger signal).

When the trigger signal is applied on the base 18*a* of the transistor 18 at a delay or a fail of turning ON of the I.G.B.T. by some reason, a larger current tends to come to flow into the gate of the SCR 22 through the strobe tuve Xe and the switch circuit 17. But such a large current which may destroy the SCR 22, can be controlled by appropriately setting the value of the resistor 25.

Furthermore, the above-mentioned delay of turning ON of the I.G.B.T., i.e. the excitation of the strobe tuve Xe after the trigger operation of the trigger circuit 20, can be prevented by inserting a capacitor $C_5$ (indicated by broken line in FIG. 1) between the gate and the cathode of the SCR 22, for example. The capacitor $C_5$ gives some delay for turning ON of the SCR 22 in comparison to the turning ON of the transistor 18. That is, it is possible to carry out turning out of the SCR 22 and subsequent triggering of the strobe tube Xe by the trigger circuit 20 after complete turning ON of the I.G.B.T. through turning ON of the transistor 18.

Moreover, a Zener diode $D_1$ (indicated by broken line in FIG. 1) can be used instead of the resistor 25 for prevention of the above-mentioned delay of turning ON of the I.G.B.T.

Figure 2:
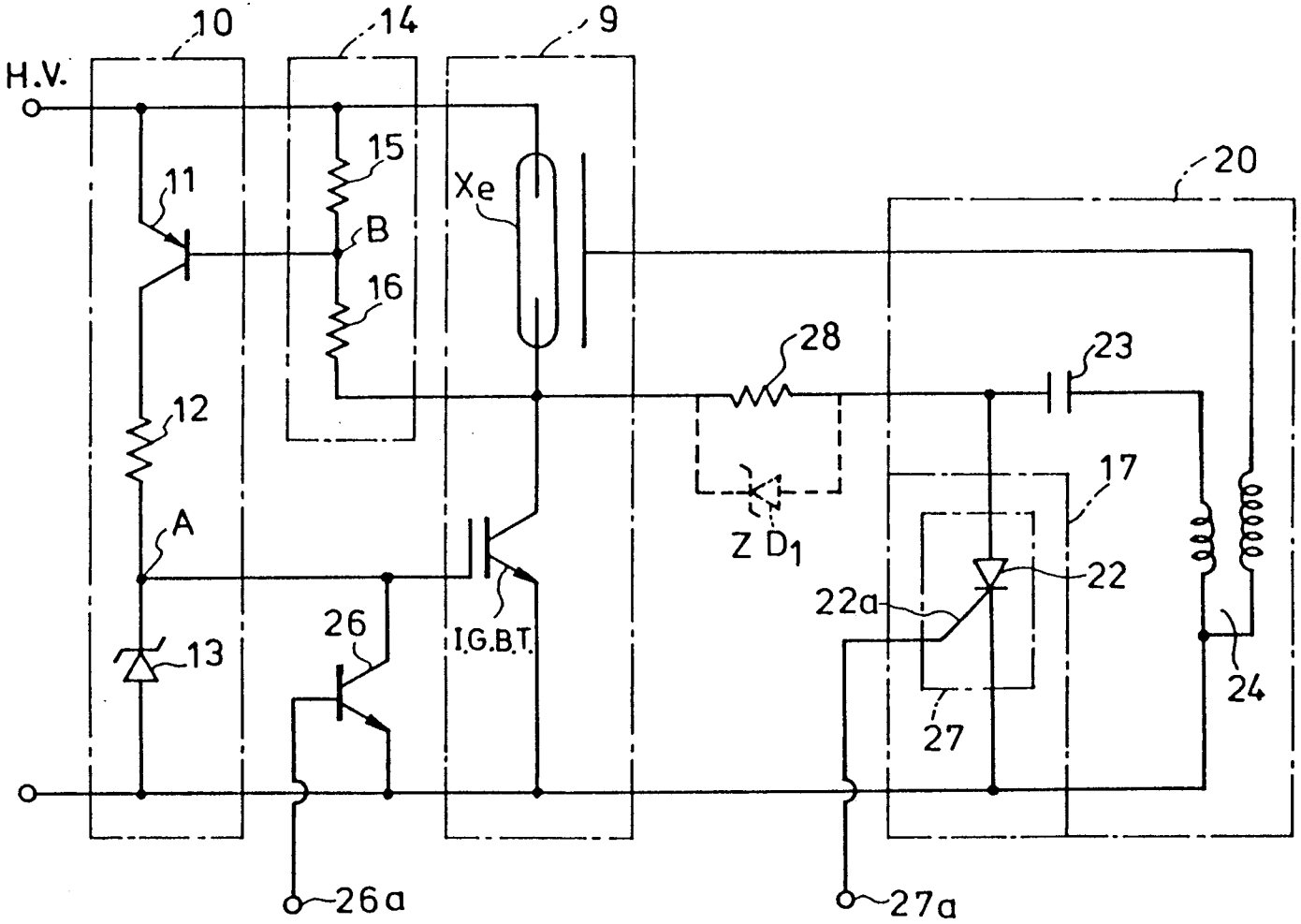
FIG. 2 is a partial circuit diagram of a second embodiment of the electric flash apparatus in accordance with the present invention.

FIG. 2 is a partial circuit diagram of electric circuit of a second embodiment of the electric flash apparatus in accordance with the present invention. Corresponding parts and components to the first embodiment are shown by the same numerals and makrs, and the description thereon made in the first embodiment similarly apply. Differences and features of this second embodiment from the first embodiment are as follows.

In the second embodiment, the trigger switching element 27 (which is the SCR 22 in this example) in the trigger circuit 20 is used in place of the switch circuit 17 of FIG. 1 in the first embodiment. That is, the SCR 22 is used as the switch circuit 17 as well as the trigger switching element 27. A resistor 28 is an element for protection of the trigger switching element 27, and for example, a Zener diode $ZD_1$ (indicated by broken line in FIG. 2) can be used instead of the resistor 28. Further the resistor 28 performs a function as a current-limiting element for prevention of unnecessary keeping ON of the SCR 22, in case the SCR 22 is used as the trigger switching element 27. As the trigger switching element 27, a transistor or the like switching element can be used instead of the SCR 22.

When a trigger signal having very short duty time is applied to the gate 22*a* of the SCR 22 which is the trigger switching element 27, the SCR 22 is turned ON, and the electric charge of the trigger capacitor 23 is discharged through the trigger transformer 24. Thereby, the known trigger operation for excitation of the strobe tube Xe is made, and simultaneously the transistor 11 is turned ON by a current flowing to the gate circuit 14 through the SCR 22. By the turning ON of the transistor 11, a voltage defined by the Zener diode 13 is applied to the gate of the I.G.B.T., and the I.G.B.T. is turned ON.

Consequently, the strobe tube Xe emits light by consuming the electric charge of the main capacitor $C_M$, and the operation of the gate circuit 14 is kept simultaneously.

During the light emission of the strobe tube Xe, when the stop signal for stopping light emission is applied to the base 26*a* of the transistor 26, the transistor 26 is turned ON, the I.G.B.T. is turned OFF, and the current flowing through the strobe tube Xe or the gate circuit 14 is interrupted similarly as mentioned in the first embodiment. Thus the light emission of the strobe tube Xe is stopped, the transistor 11 is turned OFF, and the state of the apparatus comes to the initial state which is before the emission of light.

One light emission operation of the second embodiment shown in FIG. 2 is elucidated briefly as mentioned above. In the second embodiment, a more simple circuit configuration than that of the first embodiment is realized owing to amulgamization of the switch circuit 17 and the trigger switching element 27 in one.

Figure 3:
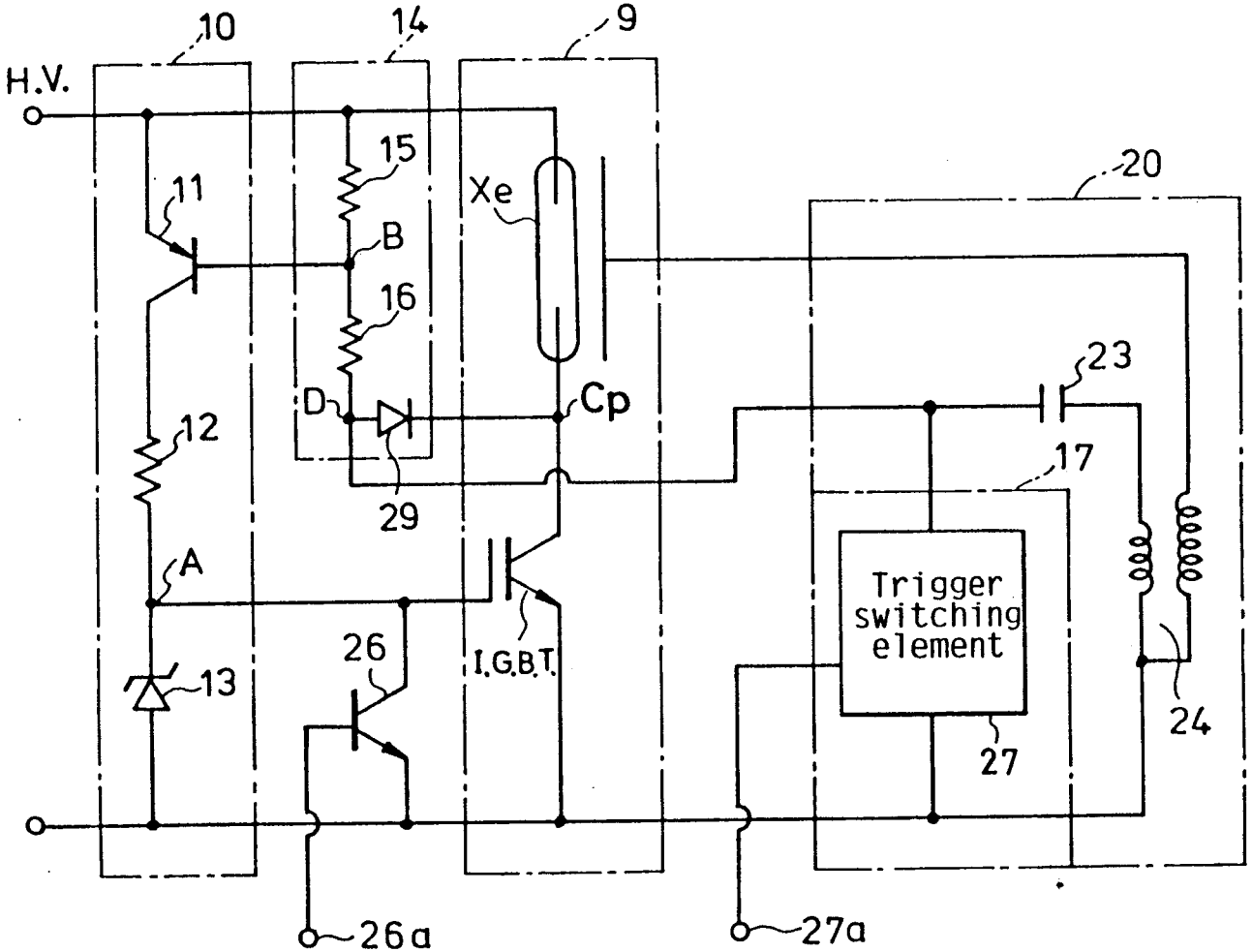
FIG. 3(*a*) is a partial circuit diagram of a third embodiment of the electric flash apparatus in accordance with the present invention.
Figure 3:
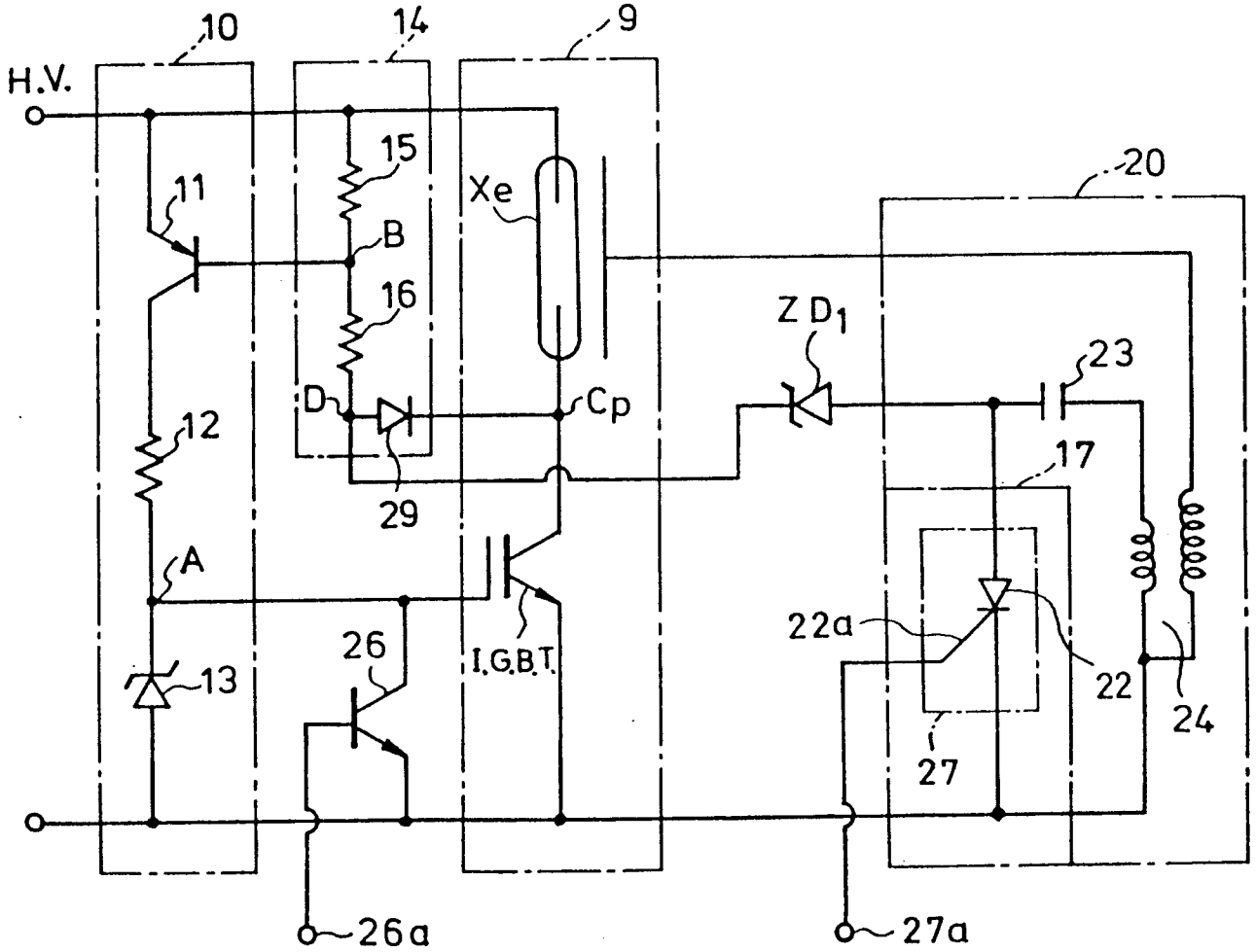

FIGS. 3(*a*) and 3(*b*) are partial circuit diagram of electric circuit of respective a third and a fourth embodiment of the electric flash apparatus in accordance with the present invention. Corresponding parts and components to the first or second embodiment are shown by the same numerals and marks, and the description thereon made in the first and second embodiment similarly apply. Differences and features of this third and fourth embodiment from the second embodiment are as follows.

In the third and fourth embodiment shown in FIGS. 3(*a*) and 3(*b*), the gate circuit 14' comprises the resistor 15, the resistor 16 and further a diode 29 in series connection. Moreover, the trigger circuit 20 including the trigger switching element 27 is connected to a connecting point "D" between the resistor 16 and the diode 29. That is, in both of the third and the fourth embodiment, the insertion of the diode 29 in the connection between the switch circuit 17 and the I.G.B.T. is made, in addition to the circuit of the second embodiment in FIG. 2.

Thus the operation of the driving circuits for the I.G.B.T. such as the second series connection 10, the gate circuit 14 and the trigger circuit 20 are almost same as the second embodiment in FIG. 2. In both third and fourth embodiments, when the trigger switching element 27 is turned ON by supply of the trigger signal, the known trigger operation of the trigger circuit 20 is made, to make a current flow through the resistors 15, 16 and the diode 29, and turn the transistor 11 ON. Thereby the voltage defined by the Zener diode 13 is applied on the gate of the I.G.B.T. Then, the I.G.B.T. is turned ON, and, the strobe tube Xe emits light, and the operation of the gate circuit 14 is retained.

When the transistor 26 is turned ON by the application of the stop signal, the I.G.B.T. is turned OFF, and thereby the light emission of the strobe tube XE is stopped, the operation of the gate circuit 14 is stopped and the transistor 11 is turned OFF. Consequently, the state of the apparatus comes to the initial state, and one light emission operation is ended.

Next, the function of the diode 29 in the third and fourth embodiment shown in FIG. 3(*a*) and 3(*b*) is elucidated hereafter.

The cathode of the diode 29 is connected to the connecting point (Cp) between the strobe tube Xe and I.G.B.T., and the current from the side of strobe tube Xe is prevented thereby. The connecting point (Cp) is the end of the strobe tube Xe. Thus during the trigger switching element 27 is turned ON, even if the I.G.B.T. is not turned OFF by some reason no large current flows through the strobe tube XE at all to the trigger switching element 27. Thereby the trigger switching element 27 is protected surely by the diode 29.

In FIG. 3(*b*), the Zener diode $ZD_1$ is inserted between the collector of the I.G.B.T. and the trigger switching element 27 for protection of the trigger switching element 27 (i.e. the SCR 22), similarly as the second embodiment (FIG. 2). Furthermore, the resistor 28 (shown in FIG. 2) can be used instead of the Zener diode $ZD_1$ (shown in FIG. 3(*b*)) as a matter of course.

Although the invention has been described in its preferred form with a certain degree of particularity, it is understood that the present disclosure of the preferred form has been changed in the details of construction and the combination and arrangement of parts may be restored to without departing from the spirit and the scope of the invention as hereinafter claimed.

What is claimed is:

1. An electric flash apparatus comprising:

a main capacitor which is connected across output terminals of a DC high voltage power source and is charged up by a DC high voltage current from the DC high voltage power source, a first series connection which comprises a strobe tube and an insulated gate bipolar transistor (I.G.B.T.) and is connected across both ends of said main capacitor, a second series connection which comprises a switching element and a constant voltage element and is connected across both ends of said main capacitor, a connecting point between said switching element and said constant voltage element being connected to the gate of the I.G.B.T., gating means which is connected across both ends of said strobe tube and makes said switching element ON when electrified, trigger means for excitation of said strobe tube, switch means which is connected across both ends of said I.G.B.T. and actuates said gating means and said trigger means at reception of a signal for starting light emission, and control means which is connected across the gate and the emitter of said I.G.B.T., and when it becomes ON makes said I.G.B.T. OFF.

2. An electric flash apparatus in accordance with claim 1, wherein said switch means comprises:

a trigger switching element provided in said trigger means.

3. An electric flash apparatus in accordance with claim 1 wherein said gating means has a diode which is connected in series to said gating means, the cathode of said diode being connected at the end of said strobe tube which is connected to the I.G.B.T., and said switch means is connected across a connecting point between said gating means and said diode, and the emitter of said I.G.B.T.

4. An electric flash apparatus comprising: a main capacitor which is connected across output terminals of a DC high voltage power source and is charged up by a DC high voltage current from the DC high voltage power source, a first series connection which comprises a strobe tube and an insulated gate bipolar transistor (I.G.B.T.) and is connected across both ends of said main capacitor, a second series connection which comprises a switching element and a constant voltage element and is connected across both ends of said main capacitor, a connecting point between said switching element and said constant voltage element being connected to the gate of the I.G.B.T., gating means which is connected across both ends of said strobe tube and makes said switching element ON when electrified, trigger means for excitation of said strobe tube, including a trigger switching element which is connected across both ends of said I.G.B.T. through a current-limiting element, to excite said strobe tube when said trigger switching element becomes ON, and control means which is connected across the gate and the emitter of said I.G.B.T., and when it becomes ON makes said I.G.B.T. OFF.

5. An electric flash apparatus in accordance with claim 4, wherein said gating means has a diode which is connected in series to said gating means, the cathode of said diode being connected at the end of said strobe tube which is connected to the I.G.B.T., and said trigger switching element is connected across a connecting point between said gating means and said diode through said current-limitting element, and the emitter of said I.G.B.T.

6. An electric flash apparatus comprising: a main capacitor which is connected across output terminals of a DC high voltage power source and is charged up by a DC high voltage current from the DC high voltage power source, a first series connection which comprises a strobe tube and an insulated gate bipolar transistor (I.G.B.T.) and is connected across both ends of said main capacitor, a second series connected which comprises a switching element and a constant voltage element and is connected across both ends of said main capacitor, a connecting point between said switching element and said constant voltage element being connected to the gate of the I.G.B.T., gating means which is connected across both ends of said strobe tube and makes said switching element ON when electrified, trigger means for excitation of said strobe tube, including a trigger switching element which is connected across both ends of said I.G.B.T. to excite said strobe tube when said trigger switching element becomes ON, and control means which is connected across the gate and the emitter of said I.G.B.T., and when it becomes ON makes said I.G.B.T. OFF.

7. An electric flash apparatus in accordance with claim 6, wherein said gating means has a diode which is connected in series to said gating means, the cathode of said diode being connected at the end of said strobe tube which is connected to the I.G.B.T., and said trigger switching element is connected across a connecting point between said gating means and said diode, and the emitter of said I.G.B.T.

* * * * *